United States Patent [19]

Priebe et al.

[11] Patent Number: 4,529,851

[45] Date of Patent: Jul. 16, 1985

[54] MACHINE INSERTABLE MINIATURE DIP SWITCH

[75] Inventors: Durward H. Priebe, Paso Robles, Calif.; Norman C. Weingart, Elkhart, Ind.; John Zdanys, Jr., Elkhart, Ind.; Jack A. English, Elkhart, Ind.

[73] Assignee: CTS Corporation, Elkhart, Ind.

[21] Appl. No.: 509,314

[22] Filed: Jun. 30, 1983

[51] Int. Cl.[3] ..... H01H 15/24

[52] U.S. Cl. ..... 200/16 D; 200/16 R; 200/291

[58] Field of Search ..... 200/16 R, 16 C, 16 D, 200/16 F, 275, 290, 291, 302

[56] References Cited

U.S. PATENT DOCUMENTS

| | | | |
|---|---|---|---|
| 3,355,565 | 11/1967 | Daul | 200/166 |
| 3,485,966 | 12/1969 | Bailey et al. | 200/16 |
| 3,493,706 | 2/1970 | Cherry et al. | 100/166 |
| 3,632,909 | 1/1972 | Rowley | 200/16 D |
| 3,643,046 | 2/1972 | Zdanys, Jr. et al. | 200/76 |
| 3,912,887 | 10/1975 | Gratz et al. | 200/16 D |
| 3,947,391 | 3/1976 | Lutzenberger | 200/16 D |
| 3,963,884 | 6/1976 | Pollock | 200/16 D |
| 3,974,346 | 8/1976 | Keprda | 200/5 B |
| 3,987,263 | 10/1976 | Ogasawara | 200/153 S |
| 4,016,377 | 4/1977 | Iwasuki | 200/16 F |
| 4,016,378 | 4/1977 | Arthur | 200/16 D |
| 4,029,917 | 6/1977 | Webster | 200/5 R |
| 4,075,442 | 2/1978 | Fukida et al. | 200/16 F |
| 4,121,062 | 10/1978 | Fujino | 200/16 F |
| 4,129,914 | 6/1978 | Schmidt | 200/1 R |
| 4,168,404 | 9/1979 | Lockard | 200/1 R |
| 4,172,972 | 10/1979 | Sykora | 200/164 R |
| 4,185,176 | 1/1980 | Matsuo | 200/16 D |
| 4,311,885 | 1/1982 | Arthur | 200/16 C |
| 4,322,588 | 3/1982 | Chumley et al. | 200/5 A |
| 4,376,234 | 3/1983 | Liataud et al. | 200/16 D X |
| 4,393,281 | 7/1983 | Ohmori et al. | 200/16 D |

FOREIGN PATENT DOCUMENTS

| | | | |
|---|---|---|---|
| 7538522 | 12/1975 | France | 200/16 D |

*Primary Examiner*—G. P. Tolin

*Attorney, Agent, or Firm*—Rodger H. Flagg

[57] ABSTRACT

A machine insertable miniature DIP switch (10) comprises a housing (12) insert molded about a plurality of terminals (40). The terminals (40) are oppositely disposed pairs having interior portions (44) located within housing chambers (30) formed by transversely extending walls (20), with the ends of the pairs of terminals separated by an open area (A) comprising a depression. An actuator (60) includes an upward extension (64) above a top plate (62) with a contactor receptacle (66) located therebelow, a depending detent wall (68) with a detent protrusion (70) on one side of the actuator, and an oppositely disposed depending actuator side wall (72). The detent protrusion (70) is received by detent openings (22) within the associated transverse wall (20), top plate extensions (63) are positioned over the associated transverse wall, and the oppositely disposed actuator side wall (72) is positioned for engagement with a shelf (24) located in the associated transverse wall. A contactor (80) comprises a U-shaped upper portion (82) received in the actuator receptacle (66) to effect a self-leveling, load equalizing coupling, and a lower portion comprising a plurality of outwardly extending legs (84), each leg (84) havng an arcuate foot (86, 87) at an end thereof. The arcuate feet (86, 87) engage the interior terminal portions (44) whereby lateral displacement of the actuator (60) effects constant pressure slideable engagement of the contactor (80) with the terminals (40) to complete or open an electrical circuit therebetween, without the contactor feet (86, 87) engaging any housing material.

20 Claims, 7 Drawing Figures

MACHINE INSERTABLE MINIATURE DIP SWITCH

DESCRIPTION

1. Technical Field

The switch assembly of this invention relates to miniature dual-in-line- package (DIP) switches for use with printed circuit boards.

2. Background Art

The electronics industry has a need for high quality miniaturized dual-in- line-package (DIP) switches which may be utilized with printed circuit boards for the opening and closing of circuits thereon. A number of switches are available on the market, but many are of a size not adapted for automatic machine insertion onto a printed circuit board. The further miniaturization of switches to a size compatible with automatic machine insertion creates a number of problems that must be overcome. It is preferable that the switch assembly require as few steps as possible and provide a structurally strong and reliable construction. In this respect, the switch should be water tight because the switches are usually secured to PC boards by means of wave-soldering techniques which permit flux residue infiltration into the switch if the parts are not right fitting, and the wave- soldering is followed by board washing whereby chemicals can and do enter and contaminate the interiors of unsealed switch constructions. Of course, as few switch manufacturing steps as possible are desirable so that the possibility of damage to the piece parts is minimized and the quality of the product improved. The design of the miniature DIP switch should provide a switch construction having a highly predictable, constant functional operation with an accompanying long cycle life.

Rose U.S. Pat. No. 4,268,728 issued May 19, 1981 and entitled "Switch Encoder" illustrates a DIP switch designed for use in electric garage door openers. The actuator moves an oval shaped contactor laterally in the housing, whereby the contactor engages and disengages the respective terminals in addition to scraping over housing material disposed between the terminals, and the actuator utilizes a flexible detent bump received in sawtooth openings located in the housing wall. Josemans U.S. Pat. No. 4,324,957 issued Apr. 13, 1982 and entitled "Slide Switch" illustrates a slide switch having a bridging contactor biased downwardly for engagement with terminals located in the housing, and with laterally extending arms received in indexing notches located in the housing. Neither the Rose U.S. Pat. No. 4,268,728 nor the Josemans U.S. Pat. No. 4,324,957 provides a structure suitable for a miniaturized machine insertable DIP switch. English U.S. Pat. No. 4,352,964 entitled "Slide and Rocker Switch Assemblies Having Double Cantilevered Contactor," issued Oct. 5, 1982 to the same assignee as herein, illustrates a miniaturized DIP switch construction suitable for machine insertion. This switch design is suitable for the assembly of either a slide or rocker switch, with the slide switch having a laterally movable actuator held in engagement with the housing by the resiliency of a double cantilevered contactor disposed within the actuator. However, this design does not provide for a constant contactor pressure on the subjacent terminals when the actuator is moved laterally by the switch user.

FIG. 1 of the drawings illustrates a slide switch provided by Alps Electric Company, Ltd. wherein a contactor with staggered contacts at one end has the other end fixedly secured within an actuator insert molded about the other end. The actuator has a side wall detent protrusion "P" received within openings in a side wall of the housing. As this actuator is moved from side to side, the staggered feet engage respective terminals in addition to wiping over housing material located between the spaced apart terminals, and the actuator-contactor securement does not provide for a load equalizing compensation in case the actuator is mounted slightly off angle within the actuator. In other words, any deviation in the securement of the contactor to the actuator, or off-center tilting of the actuator, cannot be compensated for by this design. Additionally, due to the mechanics of insert molding, the actuator when moved laterally exposes a portion of the contactor metal to contact with other external conductive user elements. Further, it is not available in machine insertable miniature DIP switch configuration.

FIG. 2 illustrates a machine insertable minature DIP switch produced by American Research and Engineering, Elgin Ill. This structure provides a multilegged contactor insert molded within an actuator having detent notches on the sides of the actuator. The detent notches receive complementary shaped dentent protrusions of the housing when the actuator is moved side-to-side in a deflection type of movement caused by the detent design. This design renders the contactor completely exposed by the incomplete cover windows, which allows exterior contaminants to enter into the switch housing and contact the contactor metal or the interior terminals, the contactor drags across abrasive housing material which results in the removal of gold plating from the contactor feet, and the detent deflection raises the contact force by a factor of approximately four which results in high wear and gouging of the plated contacts during actuation thereby exposing the underlying metal. Both of the prior art constructions by Alps Electric Company, Ltd. and American Research and Engineering contain various undesirable design features which should be eliminated in the provision of a high quality, machine insertable, miniature DIP slide switch construction.

DISCLOSURE OF THE INVENTION

The machine insertable miniature DIP switch comprises a housing insert molded about a plurality of terminals. The terminals are oppositely disposed in pairs located within housing chambers formed by transversely extending walls. The ends of the oppositely disposed terminals are separated by an open area comprising a V-shaped depression so that the feet of a contactor will not engage any housing material as it moves from terminal to terminal. The housing is formed so that the perimeter of a housing cover is received within the interior perimeter of the housing walls, and the cover has a plurality of openings which receive the upward extensions of actuators associated with the housing chambers. Each actuator includes an upward extension received in the associated cover opening, the extension disposed above a top plate with a contactor receptacle located therebelow, a depending detent wall with a detent protrusion located on one side of the actuator, and an oppositely disposed actuator side wall. The detent protrusion is received by detent openings within the associated transverse housing wall, and top plate extensions are positioned over the associated side wall.

The oppositely disposed actuator side wall extends downwardly from the top plate for engagement with a shelf located in the associated transverse wall. The contactor comprises a U-shaped upper portion received in the complementary shaped actuator receptacle to effect a self-leveling, load equalizing coupling, and a lower portion comprising four outwardly extending legs, each leg having an arcuate foot at an end thereof. Lateral displacement of the actuator provides constant pressure slideable engagement of the contactor feet with the interior terminals, without the contactor feet engaging any housing material.

The machine insertable miniature DIP switch construction of the present invention provides a cover positioned within the interior perimeter of the housing side walls. The significance of this design is that present board manufacturing methods involve the use of wave soldering techniques to attach the DIP switch to the PC board, followed by a board washing procedure. Typically, DIP switch constructions have a removable sealing film disposed over the top of the housing in order to provide complete sealing of the interior during the wave soldering and board washing procedures. By placing the perimeter of the housing cover within the interior perimeter of the housing walls, the tape adheres to the top surfaces of the housing walls to provide a complete sealing of the only portion of the switch construction which could possibly allow the entry of any washing fluids therein. Typically, prior art constructions require that the tape adhere to the sides of the housing because the interface of the cover with the housing is located at the side of the switch construction instead of at the top. The actuator of the present invention provides for complete enclosure of the associated cover opening at any lateral actuator position, and thus the subjacent contactor and terminals are not exposed for contact by an external conductive object and contaminants are impeded from entering the switch housing after the sealing tape has been removed.

The contactor is multilegged or redundant for substantial reliability improvement over single contact designs. This also effects self cleaning between the arcuate feet and the subjacent terminals. The switch construction design includes an override of contactor feet with the contact portion of the second terminal in the "on" position so that if an accidental knock or bump is imparted to the actuator, the switch will not open the circuit. The contactor comprises a U-shaped upper portion received within a complementary shaped receptacle of the actuator. Unlike the designs of the prior art devices wherein the contactor is fixedly secured within the actuator, this coupling method provides a self-leveling, load equalizing contactor. Thus, if the contactor is disposed slightly off angle or tilted, within the actuator receptacle, the contactor is free to move within the receptacle to effect a self-leveling, load equalization when the contactor feet engage the subjacent terminal or terminals. In other words, the contactor is free to move vertically, to a small extent, until it engages the top portion of the receptacle, can move to a small extent to adjust its position from end to end whereby the left and right contactor feet are positioned in the same plane as the subjacent terminals, and is free to move laterally in the Z-axis plane whereby the side-by-side feet of the two adjacent legs of each end of the contactor can self-level to the plane of the terminals so that each foot engages the terminal in the same manner. Thus, the self-leveling, load equalizing contactor-actuator coupling enables compensation for any off-angle positioning of the contactor or the actuator. This and the engagement of the actuator with the cover, provides an equal amount of contactor force exerted by each of the respective feet upon the subjacent terminals, which improves the wear life of the plating on the contactor feet and terminals.

Positioning of the detent protrusion on a side wall of the actuator housing provides a detent feature that is separate and independent from the forces exerted by the contactor onto the subjacent terminals. Movement of the detent protrusion in and out of the detent openings does not affect the amount of contact force exerted by the arcuate feet against the terminals, but still provides a positive detent "feel" to the switch user. The housing top plate has extensions positioned for engagement with the associated transverse wall during lateral displacement of the actuator, and the oppositely disposed actuator side wall is also positioned for engagement with a shelf located in the associated transverse housing wall. When the actuator is displaced laterally, any downward force exerted upon the actuator causes engagement of the actuator with the transverse walls to prevent an increase or change in the forces exerted by the contactor feet on the subjacent terminals. This provides a constant contact pressure which results in a highly predictable, functional operation of the switch with corresponding improved wear life of the plated contactors and terminals. Additionally, the contact force exerted by the contactor upon the terminals remains the same despite any wear experienced by the detent protrusion and openings in the associated wall.

The separation between the oppositely disposed terminals is a V-shaped opening so that when the contactor is displaced laterally, the contactor feet do not smear housing material onto the contacts, and the contactor feet are not abraded by the housing material.

The above-described switch design utilizes only a minimum number of switch parts, which may be assembled in a fully automated operation to produce a miniature machine insertable DIP switch having highly predictable, constant functional and operational characteristics with a correspondingly superior wear life.

BEST MODE FOR CARRYING OUT THE INVENTION

Figure 1:
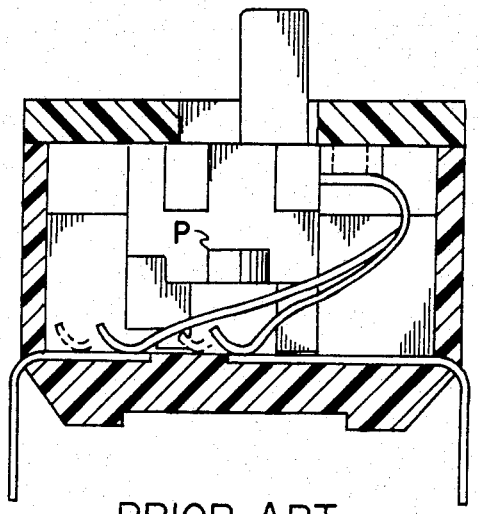
PRIOR ART Fig. 1
FIGS. 1 and 2 illustrate prior art switch constructions.
Figure 2:
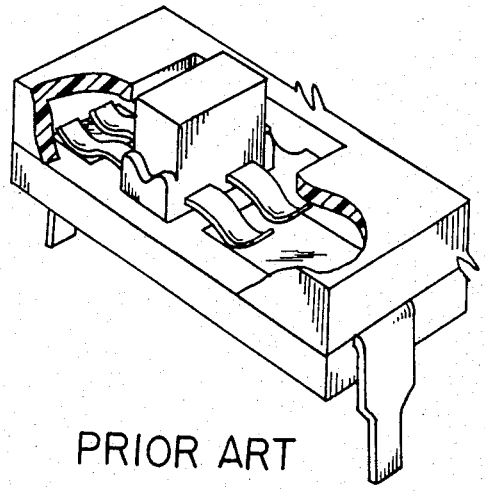
PRIOR ART Fig. 2
Figure 3:
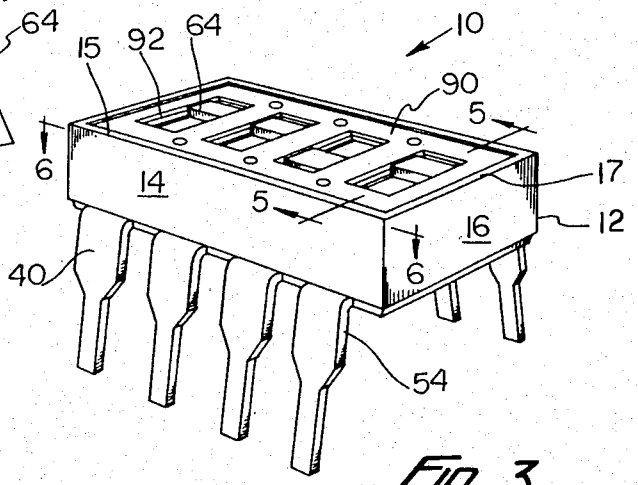
FIG. 3 is an isometric view of the miniature DIP switch of the present invention.
Figure 4:
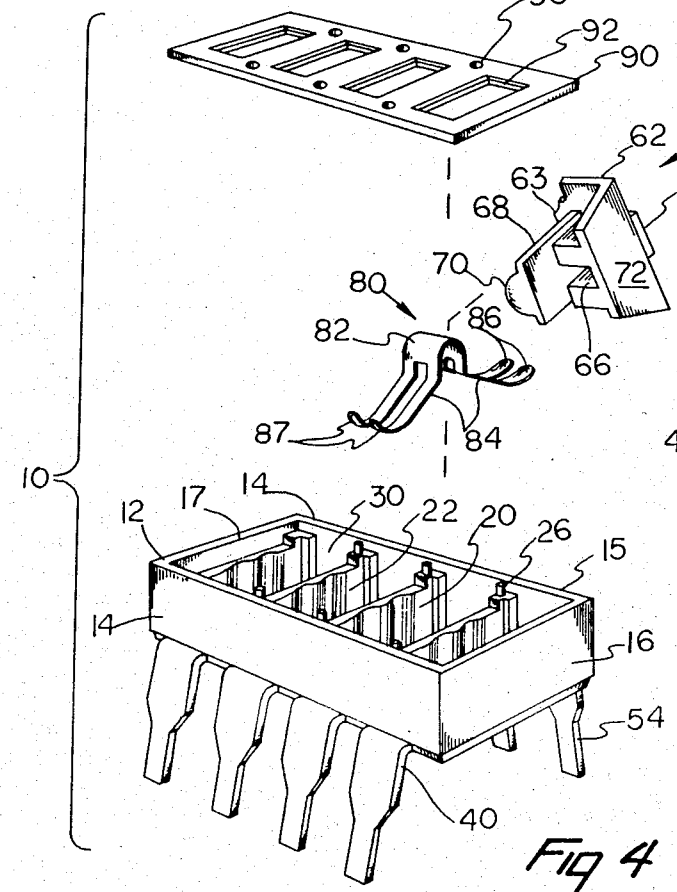
FIG. 4 is an exploded view of the miniature slide switch.
Figure 5:
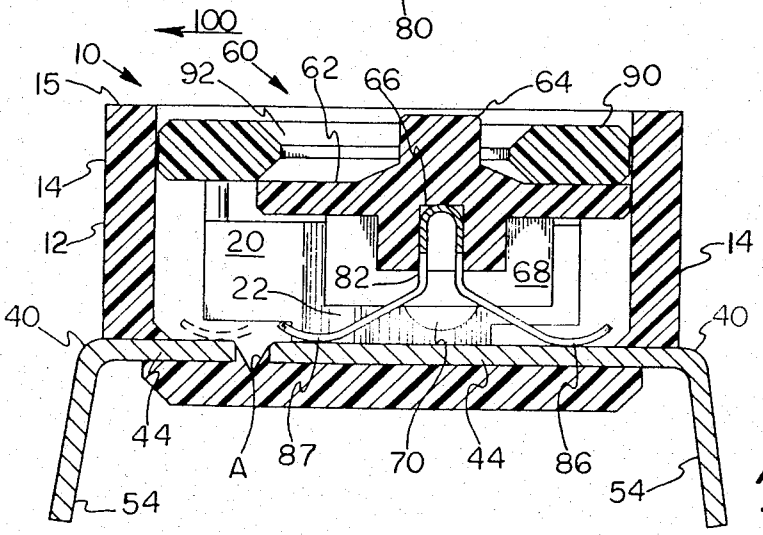
FIG. 5 is an section view taken along view line 5—5 of FIG. 3.

Referring now to the drawings, particularly FIGS. 3–5, the machine insertable miniature DIP switch is designated generally by reference numeral 10. Switch 10 comprises a generally rectangular shaped housing 12 having side walls 14 and end walls 16. Located interiorly of the housing 12 are a plurality of transverse walls 20 positioned along the length of the housing, each transverse wall having on one side detent openings 22 and on the opposite side an interior shelf 24 (see FIG. 7). Cylindrical posts 26 extend upwardly from the top ends of each wall 20. Transverse walls 20 form a series of chambers 30 within the housing 12, and a pair of oppositely disposed terminals 40 are located at the bottom of each chamber 30. Terminals 40 comprise an interior terminal portion 44 located at the bottom of chamber 30 and extending outwardly to an exterior terminal portion 54. The pair of oppositely disposed interior terminal portions 44 have their ends separated by a spaced apart area A comprising a V-shaped opening within the base.

The switch actuator 60 comprises a top plate 62 having an upward extension 64, a downwardly extending contactor receptacle 66, depending detent wall 68 with detent protrusion 70, and an oppositely disposed side wall 72. Top plate 62 has a pair of extensions 63 extending from one side. Received within each actuator 60 is a contactor 80 comprising an upper U-shaped portion 82 with four outwardly extending legs 84, each leg having an arcuate foot 86 or 87 at an end thereof. The arcuate feet 86, 87 are disposed in adjacent pairs, turned slightly upwardly, and have cross-radiuses to avoid edge or burr contact. The upper U-shaped portion 82 is received within receptacle 66 so that contactor 80 is mounted for self leveling movement. Within the X-axis, there is some slight freedom of movement so that the outwardly positioned arcuate feet 86, 87 can adjust vertically, there is some Y-axis vertical movement of the U-shaped portion 82 moving upwardly and downwardly in receptacle 66, and the contactor may move in a lateral direction (the Z-axis projecting out of the paper) so that the four arcuate feet 86, 87 contact subjacent interior terminal portions 44 with equal biasing force.

A cover 90 having a plurality of openings 92 and securement apertures 93, is positioned within the interior perimeter of the housing walls 14, 16 such that the cover 90 rests upon the tops of the transverse walls with upward posts 26 each received within an associated securement opening 93. The posts are deformed by heat staking methods well known in the art, in order to secure cover 90 to housing 12. The actuator 60-contactor 80 subassembly is forced downwardly by cover 90 whereby contactor 80 is biased into contact with subjacent interior terminal portions 44. The resiliency of contactor 80 biases actuator 60 upwardly into contact with the interior surface of cover 90, and cover 90 maintains the actuator's vertical position relative to the housing and terminals to establish a contact force exerted by the feet 86, 87 against the terminal portions 44. Detent protrusion 70 of detent wall 68 is positioned within a respective detent opening 22. Lateral movement of actuator 60 displaces the actuator in the direction of arrow 100 in FIG. 5, so that detent protrusion 70, initially preloaded into engagement with the associated detent opening, is biased inwardly until it engages the adjacent opening 22. Contactor feet 87 are displaced laterally to contact the interior terminal portion 44 of the oppositely disposed terminal 40 and complete an electrical circuit across terminals 40.

The perimeter of cover 90 lies fully within the interior perimeter of housing walls 14 and 16. When film is placed over the top of the housing 12 in order to seal the switch 10 for the wave soldering and board washing procedures, the film may be simply sealed to the top edges 15 and 17 of walls 14 and 16. In prior art constructions, the tape must be pulled over the perimeter of the cover disposed upon the top of the housing walls, and then sealed to the sides of the housing walls in order to prevent any contaminants from entering the switch during PC board assembly operations. Referring to FIG. 3, the top shelf 62 of each actuator 60 fully encloses the associated cover opening 92, so that wherever the actuator is positioned laterally within the housing, there is a complete enclosure of the associated cover opening 92 to prevent contaminants, dirt, metal and so forth from entering into the interior of the switch structure.

In order to reduce contact resistance, a bifurcated contactor 80 is utilized whereby the four outwardly extending legs 84 terminate in arcuately shaped feet 86, 87. By utilizing a plurality of legs 84 instead of a single leg, this dramatically decreases the possibility of the occurrence of any contact resistance failure as a result of foreign matter entering between a contactor leg and associated terminal. Additionally, the arcuate feet 86, 87 provide a self cleaning function as they slide over the subjacent interior terminal portions 44.

FIG. 5 illustrates in dotted line the location of contactor foot 87 when the switch is in the "on" position. As can be seen from the drawing, arcuate foot 87 is displaced far enough to the left in the direction of arrow 100, to create an overtravel of the arcuate foot upon terminal portion 44 of the left terminal. Thus, if actuator 60 is accidentally hit or jarred, this will not result in the opening or disturbance of the electrical circuit because arcuate feet 87 would not be displaced enough to break contact with terminal portion 44. The area A is a V-shaped depression insuring that arcuate feet 87 do not engage any housing material during lateral movement. It has been found that prior art constructions which allow the contactor to engage housing material disposed between the ends of the terminals results in a smearing of the material upon the terminals. Often times the material used for the housing contains a high percentage of abrasive glass material, and this further abrades and degrades the area of contact between the contactor and the terminal. By providing the depression A in the housing between the ends of the interior terminal portions 44, the problems of smearing housing material and abrasion have been fully obviated.

Figure 7:
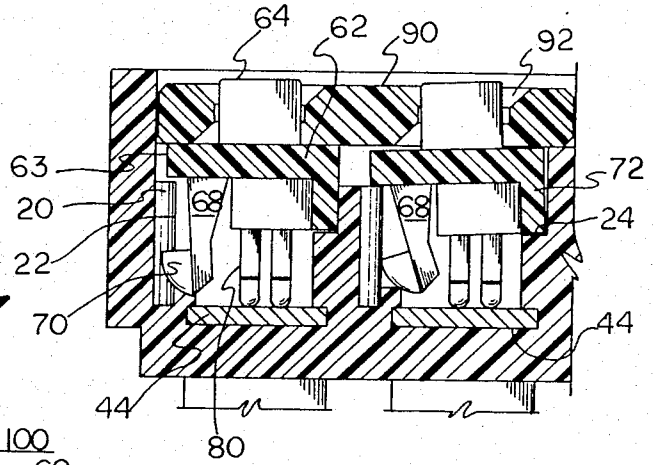
FIG. 7 is a section view taken along view line 7—7 of FIG. 6.

The U-shaped portion 82 of contactor 80 is received within the actuator receptacle 66. By not fixedly securing contactor 80 to actuator 60, there is provided a self-leveling, load equalizing compensating movement of the contactor during the assembly and operation of the switch parts. Thus, contactor 60 can move freely and self-center or self-level itself in the Z-axis so that each of the arcuate feet 86, 87 are positioned on the subjacent interior terminal portion in the same manner, with the same amount of biasing force exerted by each contactor foot against the terminal. There is provision for slight movement in the X direction in case the U-shaped portion has not been perfectly centered in receptacle 66, and U-shaped portion 82 may move vertically within receptacle 66 so that the contactor can position itself properly. Of course, once the actuator 60 and contactor 80 are disposed within the housing 12 and the cover 90 secured thereover, the cover forces the actuator-contactor subassembly downwardly whereby the contactor is biased into contact with the subjacent terminals and the resiliency of the contactor forces top plate 62 of the actuator into engagement with the interior surface of cover 90, and the U-shaped portion 82 is fully received within receptacle 66 so that its top abuts against the receptacle wall 67. Referring to FIG. 7, the switch assembly located to the right illustrates the inward movement of detent protrusion 70 as the actuator 60 is displaced laterally. The biasing force exerted by protrusion 70 and side wall 68 can cause the actuator to tilt or cant slightly, but because the contactor 80 is mounted for self-leveling, load equalizing movement, the contactor feet 86, 87 remain in contact with the terminals and constant contact force is maintained. Thus, the self-leveling, load equalizing functional feature of the actuator-contactor design, provides for both the imposition of equal biasing forces by contactor feet 86, 87 upon the subjacent terminals and the maintenance of a constant contact pressure.

Top plate extensions 63 (see FIGS. 6 and 7) are positioned over the top of the associated transverse housing wall 20, and the oppositely disposed downwardly extending side wall 72 is positioned just above a transverse wall shelf 24. When the actuator is displaced laterally, any downward force exerted on the actuator will cause wall 72 to engage shelf 24, and extension 63 to engage the top of associated transverse wall 20 to prevent any appreciable downward movement of the actuator. Because the downward movement of the actuator is minute and there is no increase in the force exerted by the contactor feet against the interior terminal portions, the maintenance of a constant contact pressure improves the wear life of the contacts and terminals by preventing the occurrence of excessive wear or gouging in the metal plating covering both the contactor and terminals.

The detent design of depending side wall 68 with detent protrusion 70 receivable in detent opening 22, provides a positive "feel" to the switch user when actuator 60 is displaced laterally. Openings 22 are not shaped complementary to the detent protrusion because such a design would allow the detent protrusion to bottom out in the openings and provide a much greater resistance to lateral movement of the actuator. It has been found that a smaller opening for engagement with the detent protrusion provides the desired initial resistance to lateral movement of the actuator while still effecting a positive detent "feel."

ASSEMBLY AND OPERATION

The method of assembling the miniature switch 10 is very similar to the assembly and forming operations described in English, U.S. Pat. No. 4,352,964, owned by the same assignee. A metal strip is blanked to form a carrier strip with terminals and then protectively plated with a metal such as gold, or a metal strip inlay may be provided for the critical portions of the terminals. The carrier strip is positioned within the cavity of an insert-molding machine, and when the die of the insert molding machine is closed, thermoplastic material is insert molded thereabout to form housing 12. The housing continues to be transported by the carrier strip as the housing-terminal subassembly proceeds through the manufacturing steps. The general manufacturing steps are not illustrated herein because they are generally known throughout the industry.

Contactors 80 are automatically inserted within switch actuators 60 and each contactor-actuator subassembly positioned within a cavity 30. Cover 90 is placed over the switch assembly 10, and posts 26 are deformed by heat staking methods well known in the art in order to secure the cover to the housing. The switch assembly then proceeds through the final step of construction wherein a die forms the terminals and trims away the metal carrier strip, although these steps may be performed earlier. During this operation, the terminals are bent downwardly to form the exterior terminal portions 54.

The switch assembly 10 is operated by pushing the projection 64 laterally so that arcuate contactor feet 87 are displaced until the detent protrusion 70 engages the adjacent detent opening 22 and the feet 87 wipingly engage or disengage an interior terminal portion 44. This movement produces a positive detent "feel" for the switch user as detent protrusion 70 moves from one detent opening 22 to the next.

Figure 6:
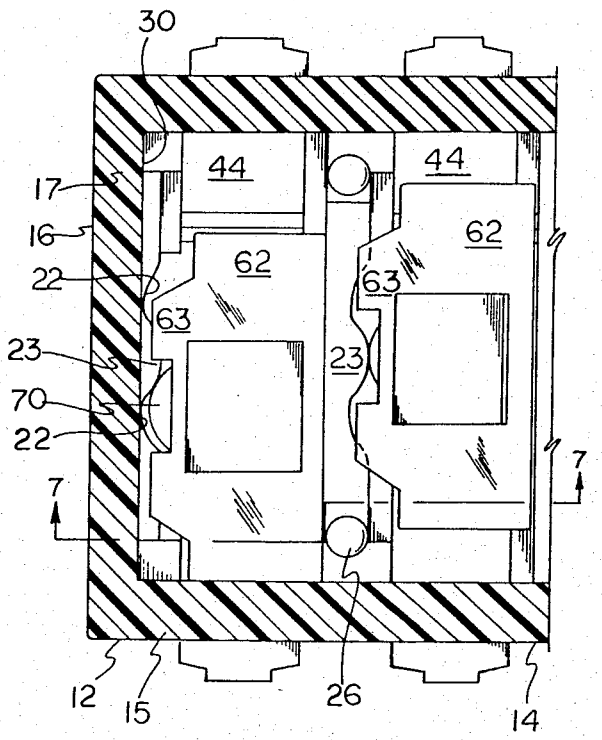
FIG. 6 is a section view taken along view line 6—6 of FIG. 3.

The operation of the detent is illustrated in FIG. 7 whereby the left side switch assembly which corresponds to the left switch assembly of FIG. 6, is in the "on" position and detent protrusion 70 is received by a detent opening 22. When the actuator 60 is displaced as illustrated by the switch assembly on the right side of FIGS. 6 and 7, the detent protrusion is biased inwardly and rides over the abutment 23 of the transverse wall until the protrusion is received by adjacent detent opening 22. FIGS. 6 and 7 also illustrate the positioning of top shelf extensions 63 over the top of the adjacent transverse wall, and the edge of the depending side wall 72 disposed over the interior transverse wall shelf 24 so that any downward force exerted upon the actuator will cause engagement therebetween and prevent any appreciable downward movement of the actuator. This insures maintenance of a constant contactor force exerted by each of the arcuate feet upon the interior terminal portions 44 by preventing any excessive downward deflection of the actuator to increase the contact forces and possibly deform the contactor.

The miniature machine insertable DIP switch assembly comprises a design which lends itself to automated mass manufacturing of the switch parts and automated assembly. The few number of steps in the manufacturing method produces a closer control of functional and structural tolerances of the parts of the switch assembly. With the new emphasis on quality control standards in order to compete with off-shore manufacturers, the switch assembly lends itself readily to complete automated processing from the initial forming steps of the parts to the final switch assembly. Thus, there are substantial savings in labor and machinery costs, and the improvement in quality minimizes the scrapage of parts and the return of defective switch assemblies. The final product switch assembly is a switch of superior quality with highly predictable, constant functional characteristics that do not deteriorate over the life of the switch.

INDUSTRIAL APPLICABILITY

The present invention may be used in conjunction with printed circuit board applications wherein a miniature DIP switch is machine inserted onto the circuit board, wave soldered thereto, and subjected to board washing operations without damaging or degrading the structural or functional characteristics of the switch.

CONCLUSION

Although the present invention has been illustrated and described in connection with an example embodiment, it will be understood that this is illustrative of the invention, and by no means restrictive thereof. It is reasonably to be expected that those skilled in the art can make numerous revisions and additions to the invention and it is intended that such revisions and additions will be included within the scope of the following claims as equivalents of the invention.

We claim:

1. A miniature switch assembly comprising a housing having a base, side walls, and a plurality of transverse walls forming individual chambers therein, a transverse wall of each chamber having first detent means, a plurality of terminals secured to said base and disposed in pairs of oppositely disposed terminals with a pair of terminals in each of said chambers, each of said oppositely disposed terminals including an interior terminal portion with a separation between the interior terminals portions and an external terminal portion extending outwardly from said housing, a plurality of actuators each disposed in one of said chambers and including an upward extension, a top plate, a contactor receptacle, and a depending detent wall with second detent means engaging the first detent means of an associated transverse wall, a contactor comprising an upper portion and a lower portion, the upper portion received in said actuator receptacle to effect a self leveling, load equalizing coupling therebetween and the lower portion comprising a plurality of depending legs with an arcuate shaped foot located at the end of each depending leg, the arcuate feet disposed for load equalizing, constant pressure sliding engagement with respective interior terminal portions of said terminals, and a cover having a plurality of apertures therein, each cover aperture providing accessibility to an associated upward extension for actuating of the respective switch.

2. The switch assembly of claim 1, further comprising a depending actuator side wall disposed opposite said depending detent wall, and a shelf disposed in the associated transverse wall whereby said depending side wall is positioned for slideable engagement along said shelf.

3. The switch assembly of claim 1, wherein said upper contactor portion comprises a U-shaped portion received in said actuator receptacle to effect said self-leveling, load equalizing coupling.

4. The switch assembly of claim 1, wherein the plurality of depending legs comprises four depending legs.

5. The switch assembly in accordance with claim 1, wherein the perimeter of said cover is disposed within the interior perimeter of said side walls.

6. The switch assembly in accordance with claim 1, wherein said second detent means is biased against said first detent means in order to stablize said actuator.

7. The switch assembly in accordance with claim 1, wherein the separation between the interior terminal portions of the terminals comprises a depression whereby actuator feet being displaced by actuation of said actuator do not engage any housing material.

8. The switch assembly in accordance with claim 1, wherein said second detent means comprises a protrusion and said first detent means comprises notches.

9. The switch assembly in accordance with claim 2, wherein said top plate extends over an associated transverse wall whereby displacement of said actuator toward said terminals is effectively prevented and maintains constant contact pressure exerted by said arcuate feet against said interior terminal portions.

10. A process providing means for the selective completion or opening of any one of a plurality of electrical circuits by means of a miniature switch assembly, comprising the steps of (a) disposing a plurality of terminals comprising oppositely disposed terminals within a switch housing, each oppositely disposed pair of terminals between transverse walls forming a series of chambers within said housing, a transverse wall of each chamber having first detent means, (b) disposing an upper portion of a multiple leg contactor within receptacle means of an actuator to effect a self-leveling, load equalizing coupling therebetween, said contactor having an arcuate foot at the end of each leg and the actuator having a depending side wall with second detent mens, (c) locating within each chamber of said switch assembly, a combination of the actuator and contactor whereby arcuate feet of each contactor engage with substantially equal contact pressure at least one terminal of said oppositely disposed terminals and said second detent means engages the first detent means of the associated transverse wall, (d) displacing an actuator from a first position to a second position whereby the associated contactor slideably engages or disengages under constant contact pressure the other of said oppositely disposed terminals to provide for the selective closing or opening, respectively, of an electrical circuit across said terminals.

11. The process in accordance with claim 10, further comprising the step of disposing a depending actuator side wall adjacent a shelf in an associated transverse wall whereby displacement of an actuator enables slidable engagement of the actuator side wall with the shelf.

12. The process in accordance with claim 11, further comprising the step of positioning a top plate extension of an actuator over an associated transverse wall whereby displacement of the actuator enables sliding engagement between the top shelf and said transverse wall.

13. The process in accordance with claim 10, further comprising the step of forming said second detent means for biased engagement with the first detent means whereby the actuator is stabilized.

14. The process in accordance with claim 10, wherein said second detent means comprises a detent protrusion and said first detent means comprises notches.

15. The process in accordance with claim 10, wherein the upper portion of said contactor is U-shaped and the contactor has four legs.

16. The process in accordance with claim 10, further comprising the step of displacing said actuator and associated contactor without the contactor feet engaging any housing material between said terminals.

17. The process in accordance with claim 10, wherein each actuator of said switch assembly is actuated by means of an associated opening in an upper wall of said housing, said opening enclosed by the top portion of the actuator.

18. The process in accordance with claim 10, wherein each of the contactors of said switch assembly is in biased engagement with the associated terminal or terminals of the respective set of oppositely disposed terminals, and displacement of the associated actuator does not substantially vary the contactor force exerted against said terminal or terminals whereby a substantially constant contact force is maintained.

19. The process in accordance with claim 10, including the step of providing a positive "feel" to the switch user when the second detent means engages or disengages the first detent means.

20. The process in accordance with claim 12, wherein engagement of the actuator side wall with the shelf and the top shelf with the associated transverse wall enables maintenance of a substantially constant force exerted by said contactor against said terminal or terminals.

* * * * *